US008246358B2

(12) United States Patent
Molnar et al.

(10) Patent No.: US 8,246,358 B2
(45) Date of Patent: Aug. 21, 2012

(54) CONTACT DEVICE AND METHOD FOR INSERTION AND REMOVAL OF DEVICE UNDER POWER WITHOUT INTERRUPTION

(75) Inventors: Nathan J. Molnar, Shaker Heights, OH (US); Douglas R. Bodmann, Shaker Heights, OH (US); David S. Wehrle, Chesterland, OH (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 12/894,770

(22) Filed: Sep. 30, 2010

(65) Prior Publication Data

US 2012/0083141 A1 Apr. 5, 2012

(51) Int. Cl.
*H01R 12/00* (2006.01)

(52) U.S. Cl. ..... 439/59; 439/636

(58) Field of Classification Search ..... 439/59–62, 439/325–328, 636, 637

See application file for complete search history.

(56) References Cited

U.S. PATENT DOCUMENTS

| | | | | |
|---|---|---|---|---|
| 2,154,301 | A | 4/1939 | Clement | |
| 4,087,151 | A * | 5/1978 | Robert et al. | 439/188 |
| 4,106,841 | A * | 8/1978 | Vladic | 439/188 |
| 4,514,030 | A * | 4/1985 | Triner et al. | 439/188 |
| 4,863,394 | A | 9/1989 | Henshaw, Jr. | |
| 4,872,851 | A | 10/1989 | Babuka et al. | |
| 4,999,787 | A | 3/1991 | McNally et al. | |
| 5,239,748 | A * | 8/1993 | Hamilton | 29/843 |
| 5,286,215 | A * | 2/1994 | Dewey et al. | 439/188 |
| 5,336,094 | A | 8/1994 | Johnson | |
| 5,584,030 | A | 12/1996 | Husak et al. | |
| 6,027,379 | A | 2/2000 | Hohorst | |
| 6,171,138 | B1 | 1/2001 | Lefebvre et al. | |
| 6,447,309 | B1 | 9/2002 | Ko et al. | |
| 6,764,345 | B1 * | 7/2004 | Duesterhoeft et al. | 439/637 |
| 6,860,766 | B2 | 3/2005 | Aujla et al. | |
| 6,918,778 | B2 * | 7/2005 | Ruckerbauer et al. | 439/260 |
| 7,922,495 | B2 * | 4/2011 | Masuda | 439/59 |

* cited by examiner

*Primary Examiner* — Thanh Tam Le

(74) *Attorney, Agent, or Firm* — Fay Sharpe LLP; R. Scott Speroff; John M. Miller

(57) ABSTRACT

A contact device enables a contact method for RIUP operations relative to a backplane. The contact device includes first and second contact portions, each including first and second spaced-apart contact arms. The first and second contact portions are located relative to each other on the backplane such that when the contact device is in a first operative condition, the respective first contact arms abut each other and define a first electrical conduction path and the second contact arms are spaced from each other. The device is selectively movable to a second operative condition when an associated circuit board or other removable device is inserted into a slot defined between the second contact arms such that outer ends of the respective first contact arms of the first and second contact portions are moved apart and are separated by the removable device and the outer ends of the second contact arms are electrically connected through the associated removable device so that a second electrical conduction path is defined by the respective second contact arms. A contact method using the contact device and a backplane including the contact device are disclosed.

11 Claims, 9 Drawing Sheets

CONTACT DEVICE AND METHOD FOR INSERTION AND REMOVAL OF DEVICE UNDER POWER WITHOUT INTERRUPTION

BACKGROUND

A wide variety of electrical contacts for electronics modules are known. Some contacts are designed especially for removal and insertion under power (RIUP) applications where a circuit board or other electronic device or component is installed in or removed from a backplane or other circuit while the backplane circuit is actively transmitting data (and also usually an operating voltage). Ideally, data continuity is maintained perfectly in the backplane circuit during the insertion and/or removal process. In practice, known contact devices/methods for such backplane circuits often result in data loss during RIUP operations. This data loss or corruption is often due to an intermittent open condition of the contacts during the component removal operation caused by the contacts not closing quickly enough upon removal of the component or by contact bounce after the initial contact closing process. Attempts have been made to overcome this problem by increasing the preload of the contacts, but this is often not sufficient to solve the problem and can lead to other problems such as excessive contact force which makes component insertion removal more difficult and which causes excessive wear on the mating contacts of the circuit board or other component that is repeatedly inserted into and removed from the backplane circuit.

SUMMARY

In accordance with one aspect of the present development, a contact device includes first and second contact portions, each of which includes a base and first and second spaced-apart contact arms projecting outwardly from the base. Each of the first and second contact arms includes an inner end connected to the base and an outer end spaced from the base. The first and second contact portions are located relative to each other such that when the contact device is in a first operative condition, the outer ends of the respective first contact arms of the first and second contact portions abut each other and define a first electrical conduction path and the outer ends of the respective second contact arms of the first and second contact portions are spaced from each other and define an open contact insertion slot there between. The contact device is selectively movable to a second operative condition when an associated removable device is inserted in the contact insertion slot such that the outer ends of the respective first contact arms of the first and second contact portions are spaced apart from each other and separated by the associated removable device and the outer ends of the respective second contact arms of the first and second contact portions are electrically connected to each other through the associated removable device so that a second electrical conduction path is defined by the respective second contact arms.

In accordance with another aspect of the present development, a contact method for an electronic device includes electrically connecting a first electrical component to a second electrical component through a first electrical conduction path of a contact device. A removable electronic device is engaged with the contact device such that a second electrical conduction path is established between the first electrical component and the second electrical component in parallel with the first electrical conduction path. After the second electrical conduction path is established, the first electrical conduction path is interrupted.

The contact method can further include disengaging the removable electronic device from the contact device after the first electrical conduction path is interrupted. This disengaging step includes moving the removable electronic device so that the pair of first contact arms engage each other to reestablish the first electrical conduction path and, after the first electrical conduction path is reestablished, separating the removable electronic device from the contact device to interrupt the second electrical conduction path.

In accordance with another aspect of the present development, a backplane includes a first electrical location, a second electrical location, and a contact device. The contact device includes a pair of first resilient contact arms that extend into an open slot between the first electrical location and the second electrical location, and also includes a pair of second resilient contact arms that extend into the open slot between the first electrical location and the second electrical location. The contact device is configured in a first operative condition when the open slot of said backplane is empty and is configured in a second operative condition when an associated removable electrical device is installed in the open slot of said backplane. The first operative condition of the contact device is defined by the second contact arms being spaced apart from each other and the first contact arms being abutted with each other to establish a first electrical conduction path between the first and second electrical locations through the first contact arms. The second operative condition of the contact device is defined by the first contact arms being spaced apart from each other and the second contact arms being abutted with respective component contacts of the associated removable electrical device to establish a second electrical conduction path between the first and second electrical locations through the pair of second resilient contact arms.

DETAILED DESCRIPTION

Figure 1:
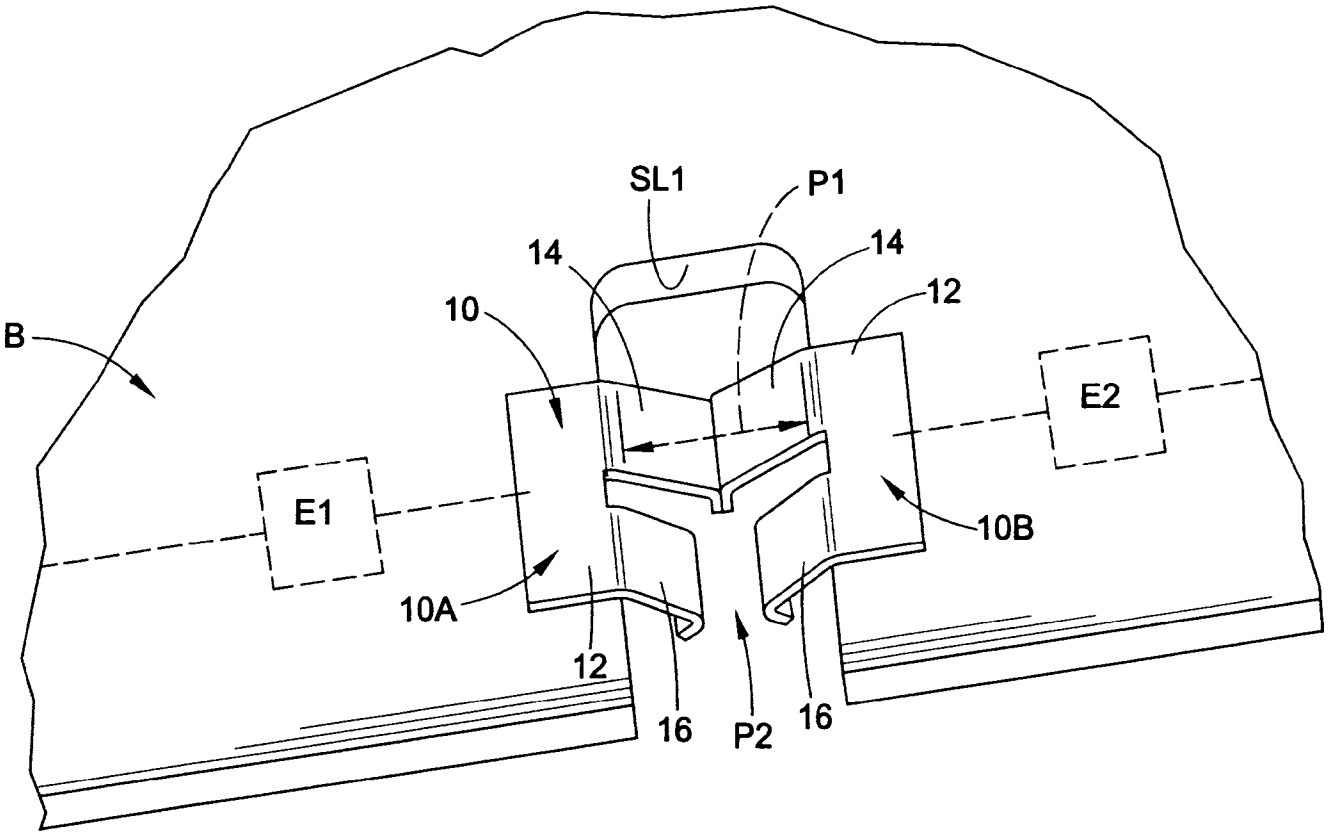
FIG. 1 is an isometric view of a backplane circuit including a contact device formed in accordance with the present development, with the contact device in a first operative condition.

FIG. 1 is an isometric view of a backplane circuit (backplane) or other circuit B including a contact device 10 formed in accordance with the present development. The contact device 10 is particularly adapted for removal and insertion under power (RIUP) of an associated electronic component such as a circuit board or other electronic component. More particularly, the backplane B comprises one or more electrical components or locations such as first and second electrical components/locations E1,E2 that are electrically connected to each other and to other electrical components through the contact device 10 for transmission of at least data and typically also an electrical power operating voltage to and between the electrical components/locations E1,E2. The backplane B typically comprises one or more circuit boards including the electrical components E1,E2 and the contact device 10 installed thereon or otherwise connected thereto.

The contact device 10 includes a first contact portion 10A located on a first side of a backplane insertion slot SL1 and electrically connected to the first electrical component/location E1, and a second contact portion 10B located on a second side of the backplane insertion slot SL1 and electrically connected to the second electrical component/location E2. The first and second contact portions 10A and 10B are preferably defined as mirror image structures relative to each other as shown herein, but they need not be.

Figure 5:
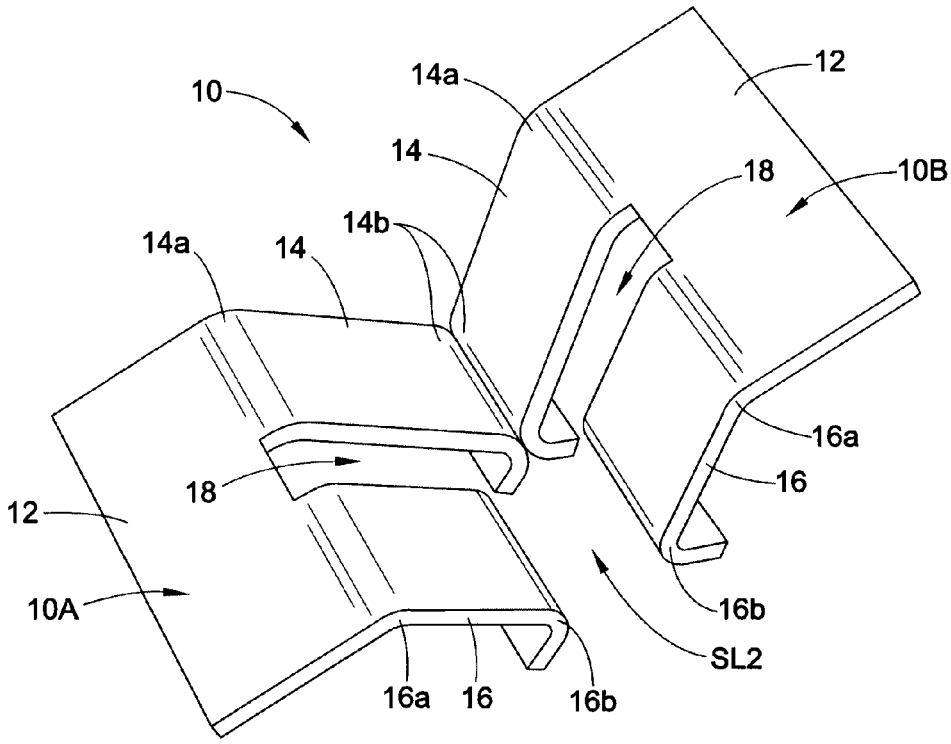
FIG. 5 shows the contact device of FIGS. 1-4 in its first operative condition.
Figure 6:
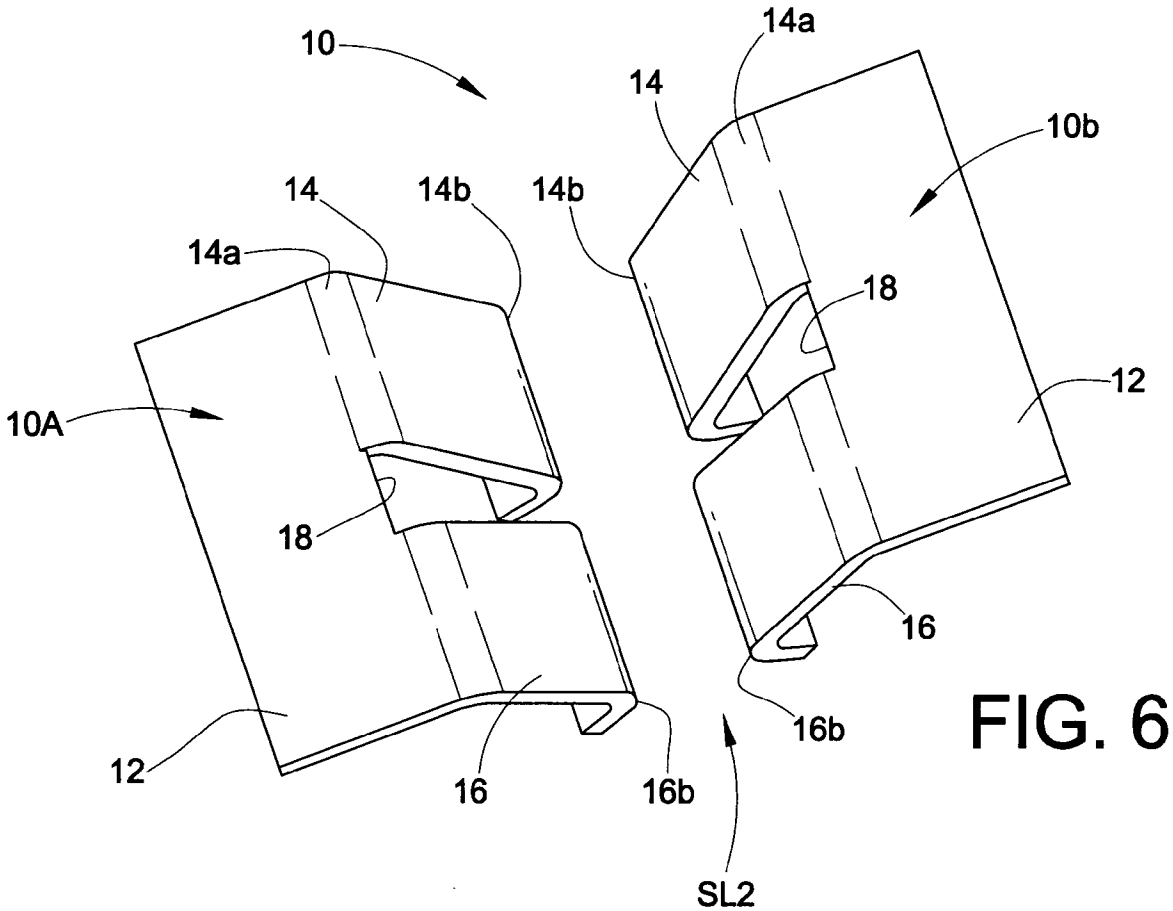
FIG. 6 shows the contact device of FIG. 5 in its second operative condition (without showing the installed circuit board engaged therewith)
Figure 7:
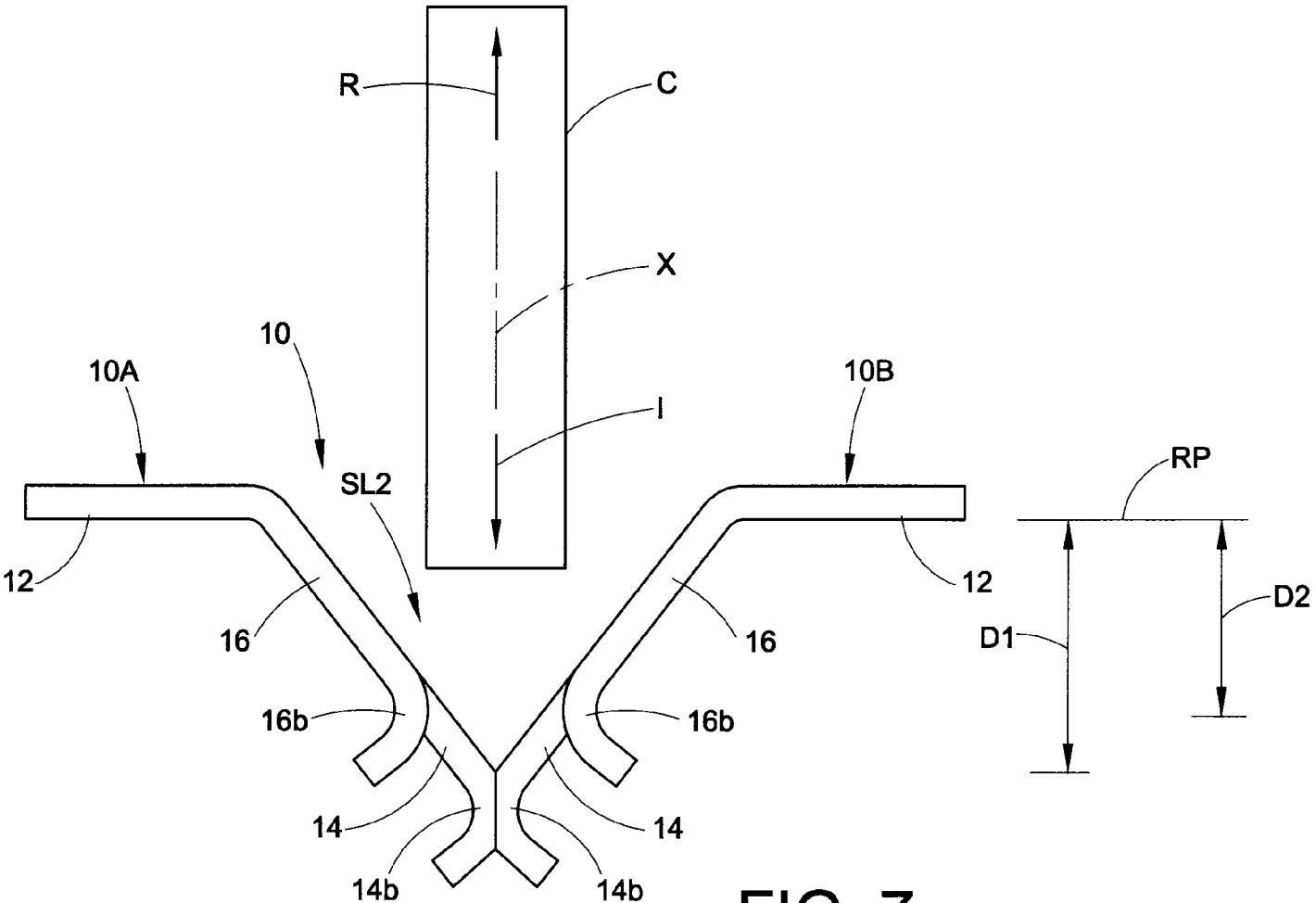
FIG. 7 is a front view of the contact device in its first operative condition.

The contact device 10 is shown separately in FIGS. 5-7. The first and second contact portions 10A,10B each comprise a base 12 and first and second spaced-apart resiliently movable contact arms 14,16 that are connected to and that project outwardly from the base 12. The contact device 10 thus includes a pair of first contact arms 14 and a pair of second contact arms 16. As shown, the first and second contact arms 14,16 are arranged parallel to each other, but they can be otherwise arranged. A space 18 (FIGS. 5 & 6) is defined between the spaced-apart contact arms 14,16 such that the contact arms 14,16 are moveable independently with respect to each other. The contact arms 14,16 of each contact portion 10A,10B are electrically connected to each other through their respective bases 12. As shown the base 12 and the first and second contact arms 14,16 of each contact portion 10A, 10B are preferably defined as a one-piece construction from an electrically conductive resilient material such as a suitable electrically conductive metal, e.g., copper, aluminum, stainless steel, or the like. Alternatively, each base 12 can comprise one or more pieces electrically connected together. For each contact portion 10A,10B, the first contact arm 14 includes an inner end 14*a* connected to the base 12 and an outer end 14*b* spaced from the base 12. Likewise, for each contact portion 10A,10B, the second contact arm 16 includes an inner end 16*a* connected to the base 12 and an outer end 16*b* spaced from the base 12.

When the contact device 10 is installed on a backplane or in another location, the respective bases 12 of the first and second contact portions 10A,10B are connected to the opposite first and second sides of the backplane insertion slot SL1, and the respective first and second contact arms 14,16 extend into the backplane insertion slot SL1. FIGS. 1, 5 and 7 show the contact device 10 in its first operative, normally closed condition in which the outer ends 14*b* of the respective first contact arms 14 are abutted with and electrically connected to each other. As such, a first electrical conduction path P1 for conduction power and/or data from the base 12 of one contact portion 10A,10B to the base 12 of the other contact portion 10A,10B is defined through the connected first contact arms 14. The first contact arms 14 are located, dimensioned and otherwise configured such that their respective outer ends 14*b* are resiliently urged into contact with each other. In the first condition of the contact device 10, the respective outer ends 16*b* of the second contact arms 16 are spaced-apart from each other so as to be electrically disconnected from each other. The space between the first contact arms 16 defines an open contact insertion slot SL2 that is aligned with and located in the backplane insertion slot SL1 of the backplane B.

Figure 2:
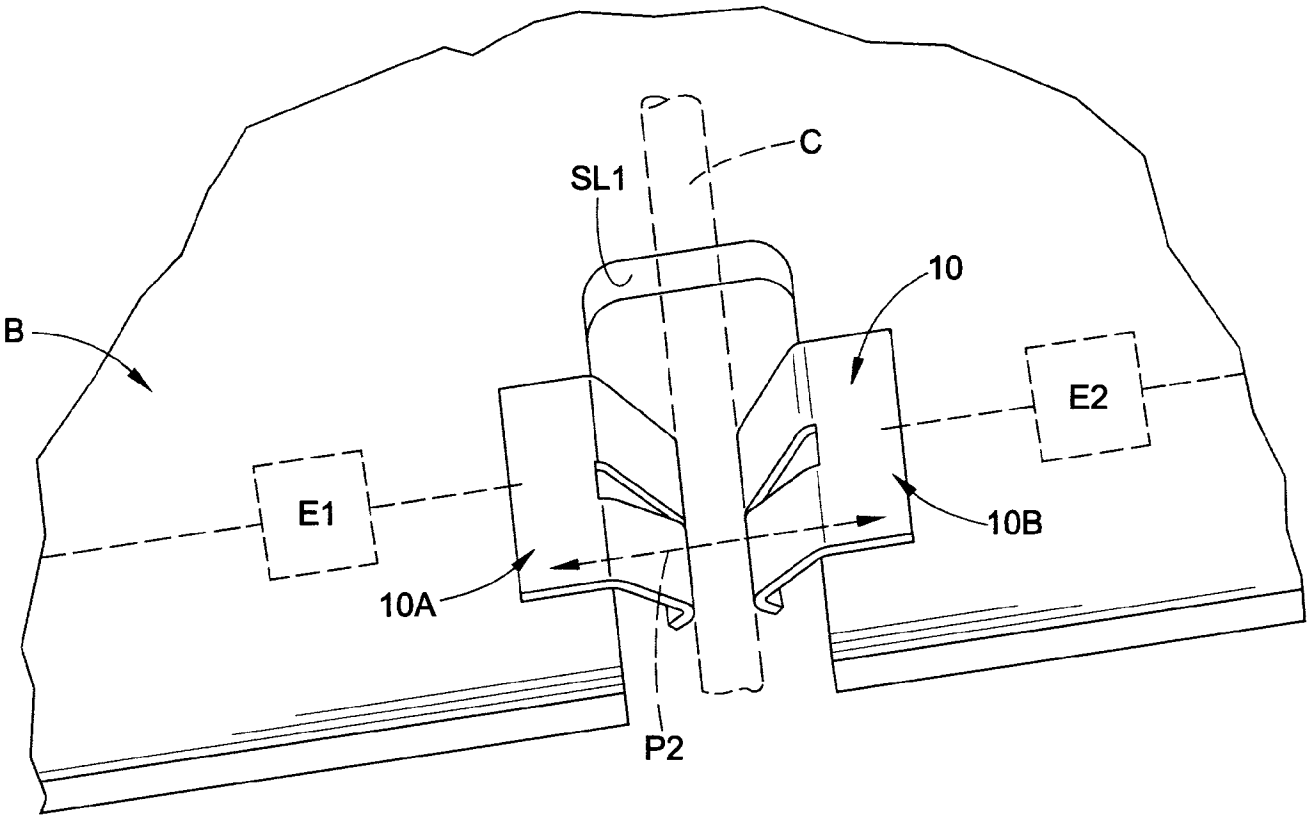
FIG. 2 is similar to FIG. 1 but shows a removable circuit board engaged with the contact device so as to be installed on the backplane, wherein the contact device is in a second operative condition.
Figure 3:
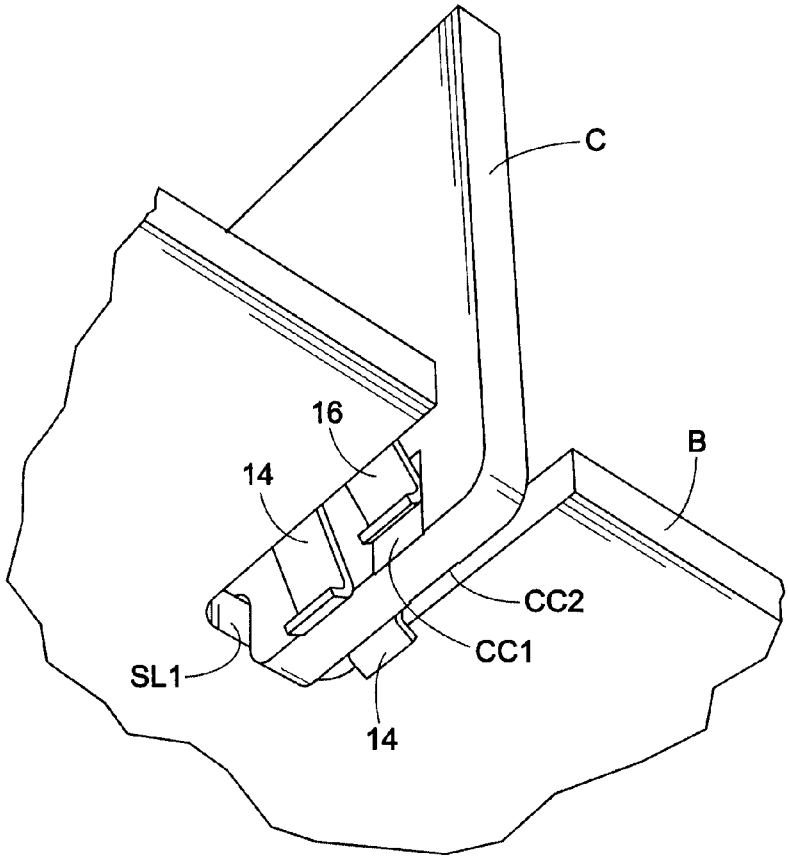
FIGS. 3 and 4 are first and second isometric views of the backplane circuit and installed circuit board of FIG. 2 showing an underside of the contact device.
Figure 4:
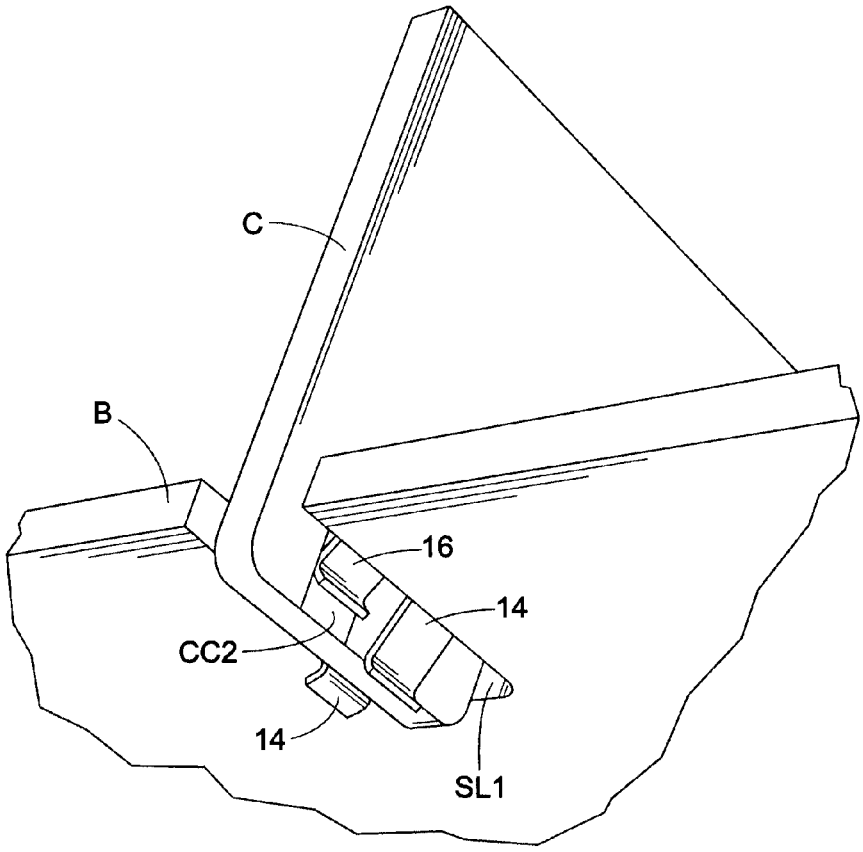

Referring also to FIGS. 2-4, an associated removable electrical/electronic device or component C, such as a circuit board or other electrical/electronic device, is selectively installed in the contact insertion slot SL2 of the contact device 10 and in the aligned backplane insertion slot SL1 of the backplane B. When so installed, the removable electrical component C resiliently moves the contact device 10 to its second operative condition in which the outer ends 14*b* of the first contact arms 14 are spaced apart from each other and are in contact with respective spaced-apart portions (e.g., opposite faces) of the removable electrical component C. In this position, the first contact arms 14 are not directly electrically connected. When the contact device is in its second operative condition, the outer ends 16*b* of the second contact arms 16 are respectively in contact with first and second component contacts CC1 (FIG. 3) and CC2 (FIG. 4) of the removable component C. Preferably, the second contact arms 16 are resiliently urged away from each other by the presence of the removable component C in the contact insertion slot SL2, which ensures that the outer ends 16*b* of the second contact arms are resiliently biased into contact with the respective component contacts CC1,CC2 by the natural resiliency of the material from which the first and second contact portions 10A,10B are defined. Because the first and second component contacts CC1,CC2 of the removable component C are electrically connected to each other through the removable component C, itself, a second electrical conduction path P2 (FIG. 2) for conduction power and/or data from the base 12 of one contact portion 10A,10B to the base 12 of the other contact portion 10A,10B is defined through the second contact arms 16 when the removable device C is installed in the contact insertion slot SL2.

Those of ordinary skill in the art will recognize that the contact device 10 provides the first electrical conduction path P1 when the contact device is in its first operative condition (FIG. 1) and provides the second electrical conduction path P2 when the contact device is in its second operative position (FIGS. 2-4). As such, at least one electrical conduction path P1,P2 is always present between the first and second electrical components/locations E1,E2 of the backplane B, whether or not the removable device C is installed to the backplane B. The contact device 10 is configured to ensure that upon insertion of the removable device C, the second electrical conduction path P2 is made or established before the first electrical conduction path P1 is broken. Conversely, the contact device 10 is configured to ensure that upon removal of the removable device C, the first electrical conduction path P1 is made or reestablished before the second electrical conduction path P2 is broken. During both the insertion and removal procedure for the removable device C, both electrical conduction paths P1,P2 exist in parallel for a brief time before one of the paths is broken, and the existence of these parallel paths P1,P2 is important to ensure that no data is lost or corrupted during RIUP operations with the removable device C.

With reference to FIG. 7, it can be seen that the removable device C is inserted into the contact device 10 in a linear insertion direction I and removed from the contact device 10 in a linear removal direction R that is opposite the insertion direction. The insertion and removal directions are defined along an insertion and removal axis X that lies in a plane that bisects the interface between the outer ends 14*b* of the first contact arms 14 and that that bisects the contact insertion slot SL2 defined between the outer ends 16*b* of the second contact arms 16. The first contact arms 14 extend toward each other and inwardly away from their respective bases in the insertion direction I so that they converge toward the insertion and removal axis X and make contact at a first distance D1 measured from a reference plane RP containing or parallel to both bases 12. The second contact arms 16 also extend toward each other and inwardly away from their respective bases in the insertion direction I so that they converge toward the insertion and removal axis X. The minimum width of the contact insertion slot SL2 is defined between the second contact arms 16 at a second distance D2 measured from the reference plane RP, wherein D2<D1. As such, those of ordinary skill in the art will recognize that a removable component C inserted into the contact device 10 in the direction I will contact the second contact arms 16 and make the second electrical conduction path P2 before the removable component C breaks the first electrical conduction path P1 by separating the first contact arms 14 from each other. Conversely, when a removable component C disengaged from the contact device 10 by its movement in the direction R the first electrical conduction path P1 is reestablished by contact between the pair of first contact arms 14 before either one of the component contacts CC1,CC2 of the removable component C separates from its respective second contact arm 16.

The contact device 10 enables a contact method wherein the first electrical component/location E1 of the backplane B is electrically connected to the second electrical component/location E2 of the backplane B through the first electrical conduction path P1. The removable electronic device C is then engaged with the contact device 10 such that the second electrical conduction path P2 is established between said first electrical component/location E1 and the second electrical component/location E2 in parallel with the first electrical conduction path P1 by electrical connection of the second contact arms 16 with the respective component contacts CC1, CC2 of the removable electronic device C. After the second electrical conduction path P2 is established, the first electrical conduction path P1 is interrupted by further insertion of the removable electronic device C into the slots SL1,SL2 such that the first contact arms 14 are separated from each other. The method further includes disengaging the removable electronic device C from the contact device 10. This disengaging step includes moving the removable electronic device so that the pair of first contact arms 14 engage each other to reestablish the first electrical conduction path P1 and, after that, separating the removable electronic device C from the contact device 10 to interrupt the second electrical conduction path P2.

The backplane B comprising the contact device 10 thus enables RIUP operations for the removable device C. The pair of first resilient contact arms 14 extend into the open slot SL1 between the first electrical component/location E1 and the second electrical component/location E2. The pair of second resilient contact arms 16 also that extend into the open slot SL1. The contact device 10 is configured in a first operative condition when the open slot SL1 of said backplane B is empty and is configured in a second operative condition when the removable electrical device C is installed in the open slot SL1 of said backplane B. The first operative condition of the contact device 10 is defined by the pair of second contact arms being spaced apart from each other and the pair of first resilient contact arms being abutted with each other to establish the first electrical conduction path P1. The second operative condition of the contact device 10 is defined by the pair of first contact arms 14 spaced apart from each other and the pair of second resilient contact arms 16 in contact with the respective component contacts CC1,CC2 of the removable electrical device C to establish the second electrical conduction path P2.

Figure 8:
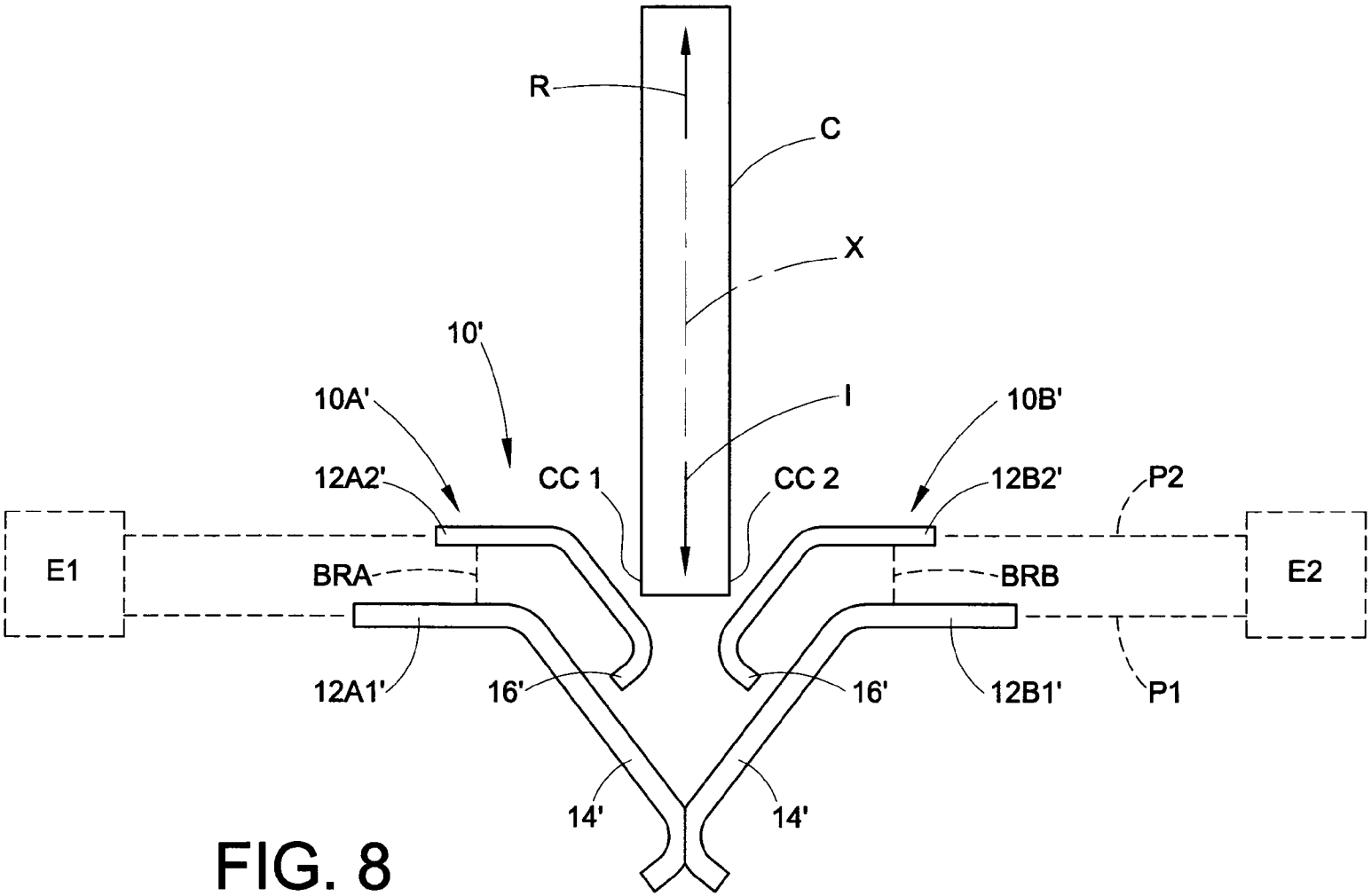
FIG. 8 is a front view of an alternative contact device formed in accordance with the present development (in its first operative condition) and shows an associated circuit board being installed or removed.

As shown in the FIGS. 1-7, the contact arms 14,16 are located adjacent to each other along the axis of the mating card edge but they may also be located on top of each other in an orientation co-axial with the direction of PCB insertion I to conserve space and/or for other reasons. FIG. 8 shows one such example, wherein the contact device 10' comprises a first contact portion 10A' and a second contact portion 10B'.

The first contact portion 10A' includes a first base portion 12A1' from which extends the first contact arm 14' and includes a second base portion 12A2' from which the second contact arm 16' extends. The first and second base portions 12A1',12A2' are electrically connected to the first electrical component/location E1 and are optionally physically connected to each other as a one-piece construction and/or by a bridge element BRA that is electrically conductive or not. For example, the first contact portion 10A', including the first and second base portions 12A1',12A2' and the contact arms 14', 16' can be a one-piece construction defined from a suitable electrically conductive metal or the first and second base portions 12A1',12A2' can be separate structures connected by soldering or the like to define the bridge element BRA. The first and second contact arms 14',16' of the first contact portion 10A' are arranged in a stacked configuration so that the second contact arm 16' is spaced above or outward from the first contact arm 14' relative to the insertion and removal axis X along with the circuit board C is inserted in the insertion direction I and removed in the removal direction R.

The second contact portion 10B' is arranged as a mirror image of the first contact portion 10A'. As such, the second contact portion 10B' includes a first base portion 12B1' from which extends the first contact arm 14' and includes a second base portion 12B2' from which the second contact arm 16' extends. The first and second base portions 12B1',12B2' are electrically connected to the second electrical component/location E2 and are optionally physically connected to each other as a one-piece construction and/or by a bridge element BRB that is electrically conductive or not. For example, the second contact portion 10B' including the first and second base portions 12B1',12B2' and the contact arms 14',16', can be a one-piece construction defined from a suitable electrically conductive metal or the first and second base portions 12B1',12B2' thereof can be separate structures connected by soldering or the like to define the bridge element BRB. The first and second contact arms 14',16' of the second contact portion 10B' are arranged in a stacked configuration so that the second contact arm 16' is spaced above or outward from the first contact arm 14' relative to the insertion and removal axis X along with the circuit board C is inserted in the insertion direction I and removed in the removal direction R.

Those of ordinary skill in the art will recognize that the circuit board or other removable electronic device C being inserted in direction I will first make the connection with both second contact arms 16' to establish the path P2 before the circuit board C is inserted sufficiently to spread the first contact arms 14' apart from each other to break the connection path P1. Conversely, upon removal of the circuit board C in the opposite direction R, the first contact arms 14' will resiliently move into contact with each other to reestablish the path P1 before the circuit board C is electrically disconnected from the second contact arms 16' to break the path P2. Another issue faced in RIUP applications is that the removal or insertion of a communications or other module including the circuit board or other electronic device C can occur asynchronously. The circuit board or other electronic device C may be in the process of communicating with or through one of the electrical devices/locations E1,E2 of the backplane through one or more of the connection paths P1,P2 that are about to be broken. This is especially a problem in make-before-break type topologies. To overcome these issues, an alternative embodiment of the contact device 10" as shown in FIG. 9 provides a microprocessor or other intelligent portion of the circuit board/device C with an early notification (e.g., a plurality of milliseconds) when the connection path P2 is about to be broken upon removal of the device C, and provides the microprocessor or other intelligent sub-system of the circuit board/device C with a signal that the removable device C fully seated and the path P2 is fully made and ready for use.

Figure 9:
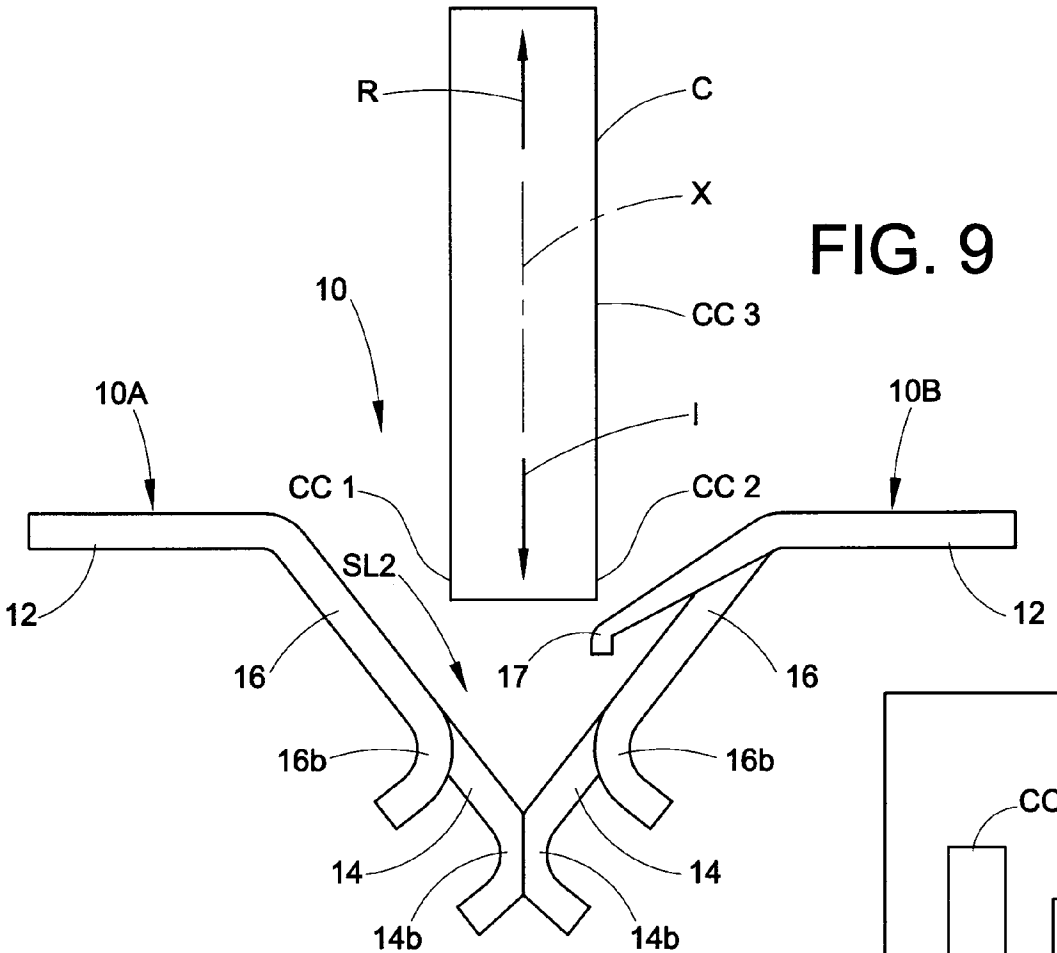
FIG. 9 illustrates another alternative contact device formed in accordance with the present development, including an annunciation contact arm in addition to the pair of first contact arms and the pair of second contact arms, and shows an associated electronic circuit board device being installed or removed.
Figure 10:
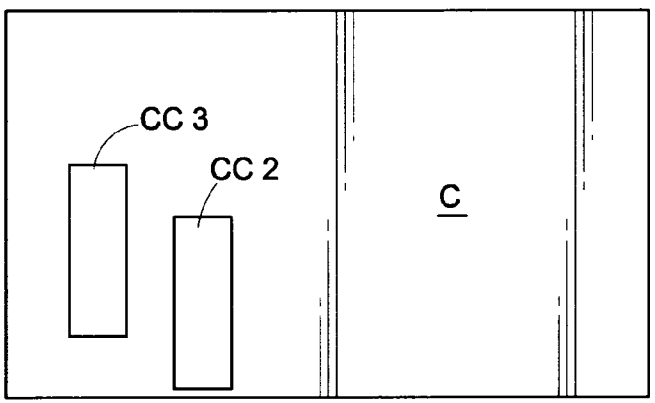
FIG. 10 is a side view of the removable electronic circuit board device of FIG. 9 illustrating the annunciation contact in accordance with the present development.

In particular, FIG. 9 shows a contact device 10" that is the same as the contact device 10 or 10' except that it further includes one or more than one third contact arm 17 (also referred to as an "annunciation contact arm") that is configured to be the last to make electrical connection with a mating annunciation contact of the removable circuit board/device C upon insertion of the board/device (i.e. "make last" with respect to the removable circuit board/device C) and that is configured to be the first to terminate electrical connection with its corresponding annunciation contact of the removable circuit board/device C upon removable of the circuit board/device C (i.e., "break first" with respect to the removable circuit board/device). As noted, the third contact arm 17 requires a third or annunciation component contact CC3 on the removable device C (see also FIG. 10) that is located to enable this make/break sequence, i.e., third contact arm 17 must make electrical contact with the annunciation contact CC3 only after the second contact arms 16 make electrical contact with the first and second component contacts CC1, CC2 upon insertion of the circuit board or other device C (to indicate that the second electrical conduction path P2 is made), and third contact arm 17 must break electrical contact with the third component contact CC3 before the second contact arms 16 break electrical contact with the first and second component contacts CC1,CC2 (to indicate that the second electrical conduction path P2 is about to be broken). Making or breaking the electrical contact between the annunciation contact arm 17 and the annunciation component contact CC3 causes a simple voltage signal to change state before a break in the path P2 occurs (or after a completion of the path P2 is made), and the voltage signal state change at the annunciation contact CC3 indicates the upcoming insertion or removal of the removable device C so that power and/or data traveling via path P2 can be controlled and/or so that any data sent or received via path P2 can be disregarded during the transition of the path P2 between its completed and opened states. For example, a change in voltage at the annunciation contact CC3 acts as an indicator by loss of signal power telling the removing module C to stop communicating. This will prevent simultaneous communication from the module C and another source. The signal at the annunciation contact CC3 can be routed to an enable/disable control, chip select, or interrupt line on a microprocessor of the device C. This annunciation signal can tell the removable module C to end communication or terminate gracefully. Likewise, the same annunciation can tell the module C not to communication through the new connection P2 until the module C is completely seated in the connector 10". Also, the annunciation via component contact CC3 and the annunciation contact arm 17 can be used to tell the module C that shock and/or vibration has occurred if the contact between the third contact arm 17 and the third component contact CC3 is intermittent due to shock and vibration which causes variations in voltage at the third component contact CC3, in which case the connection path P2 is no longer reliable and the module C will the take the appropriate action to error check, resend data, or the like. As such, the embodiment 10" of FIG. 9 provides an electrical solution for the situation in which there is a parallel path in which data is traveling and it's desirable to know which path is intended.

The development has been described with reference to preferred embodiments. Those of ordinary skill in the art will recognize that modifications and alterations to the preferred embodiments are possible. The disclosed preferred embodiments are not intended to limit the scope of the following claims, which are to be construed as broadly as possible, whether literally or according to the doctrine of equivalents.

The invention claimed is:

1. An electrical contact device comprising:

first and second contact portions, each of said first and second contact portions comprising first and second spaced-apart contact arms, and each of said first and second contact portions further comprising a base, wherein said first and second contact arms each include an inner end connected to the base and an outer end spaced from the base;

said first and second contact portions located relative to each other such that when said contact device is in a first operative condition, said outer ends of the respective first contact arms of the first and second contact portions abut each other and define a first electrical conduction path and said outer ends of the respective second contact arms of the first and second contact portions are spaced from each other and define an open contact insertion slot there between;

said contact device selectively movable to a second operative condition when an associated removable device is inserted in said contact insertion slot such that said outer ends of the respective first contact arms of the first and second contact portions are spaced apart from each other and separated by said associated removable device and said outer ends of the respective second contact arms of the first and second contact portions are electrically connected to each other through the associated removable device so that a second electrical conduction path is defined by the respective second contact arms;

said contact device connected to a backplane, wherein said base of said first contact portion is electrically connected to a first electrical location on said backplane and said base of said second contact portion is electrically connected to a second electrical location on said backplane, wherein said backplane comprises a backplane insertion slot and the respective bases of the first and second contact portions are connected to opposite first and second sides of the backplane insertion slot such that the respective first and second contact arms extend into the backplane insertion slot and such that said contact insertion slot defined between the respective second contact arms is aligned with the backplane insertion slot.

2. The contact device as set forth in claim 1, wherein said first and second contact portions are mirror image structures relative to each other.

3. The contact device as set forth in claim 2, wherein said respective first contact arms of the first and second contact portions converge toward each other and contact each other at a location aligned with an insertion and removal axis along which the associated removable device is inserted into the contact insertion slot in an insertion direction.

4. The contact device as set forth in claim 3, wherein:

the respective first contact arms of the first and second contact portions extend inwardly in the insertion direction and contact each other at a first distance measured from a reference plane;

the respective second contact arms of the first and second contact portions extend inwardly in the insertion direction and a minimum width of the contact insertion slot is defined between the second contact arms at a second distance measured from the reference plane, wherein the second distance is less than the first distance.

5. The contact device as set forth in claim 4, wherein said first and second contact arms of each of said first and second contact portions are arranged parallel with respect to each other and wherein a slot separates said first contact arm from said second contact arm.

6. The contact device as set forth in claim 2, wherein, for each of said first and second contact portions, said second contact arm thereof is spaced above said first contact arm thereof.

7. The contact device as set forth in claim 1, wherein said first contact portion is defined as a first one-piece construction and said second contact portion is defined as a second one-piece construction.

8. An electrical contact device comprising:

first and second contact portions, each of said contact portions comprising first and second spaced-apart contact arms;

said first and second contact portions located relative to each other such that when said contact device is in a first operative condition, said outer ends of the respective first contact arms of the first and second contact portions abut each other and define a first electrical conduction path and said outer ends of the respective second contact arms of the first and second contact portions are spaced from each other and define an open contact insertion slot there between;

said contact device selectively movable to a second operative condition when an associated removable device is inserted in said contact insertion slot such that said outer ends of the respective first contact arms of the first and second contact portions are spaced apart from each other and separated by said associated removable device and said outer ends of the respective second contact arms of the first and second contact portions are electrically connected to each other through the associated removable device so that a second electrical conduction path is defined by the respective second contact arms;

a third contact arm extending from at least one of the first and second contact portions, wherein said third contact arm electrically connects with said associated removable device when said associated removable device is inserted in said contact insertion slot to indicate that said contact device is in its second operative condition and to indicate that said second electrical conduction path is established.

9. The contact device as set forth in claim 8, wherein said first contact portion is defined as a first one-piece construction and said second contact portion is defined as a second one-piece construction.

10. A backplane comprising:

a first electrical location;

a second electrical location;

a contact device comprising:

a pair of first resilient contact arms that extend into an open slot between the first electrical location and the second electrical location; and, a pair of second resilient contact arms that extend into said open slot between the first electrical location and the second electrical location;

said contact device configured in a first operative condition when said open slot of said backplane is empty and is configured in a second operative condition when an associated removable electrical device is installed in said open slot of said backplane, wherein:

said first operative condition of said contact device is defined by said pair of second contact arms spaced apart from each other and said pair of first resilient contact arms abutted with each other to establish a first electrical conduction path between said first and second electrical locations through said pair of first resilient contact arms;

said second operative condition of said contact device is defined by said pair of first contact arms spaced apart from each other and said pair of second resilient contact arms abutted with respective component contacts of the associated removable electrical device to establish a second electrical conduction path between said first and second electrical locations through said pair of second resilient contact arms.

11. The backplane as set forth in claim 10, wherein said pair of second contact arms are spaced above said pair of first contact arms with respect to an insertion and removal axis along which the associated removable electrical device is installed in said open slot of said backplane.

* * * * *